US012544636B2

(12) United States Patent
Chen

(10) Patent No.: US 12,544,636 B2
(45) Date of Patent: Feb. 10, 2026

(54) FLAT ROLL-UP STRUCTURE FOR ROLLING UP NET BODY

(71) Applicant: Benjamin Chen, Taichung (TW)

(72) Inventor: Benjamin Chen, Taichung (TW)

( * ) Notice: Subject to any disclaimer, the term of this patent is extended or adjusted under 35 U.S.C. 154(b) by 483 days.

(21) Appl. No.: 18/204,219

(22) Filed: May 31, 2023

(65) Prior Publication Data

US 2024/0399224 A1 Dec. 5, 2024

(51) Int. Cl.
*A63B 61/02* (2006.01)
*A63B 61/00* (2006.01)

(52) U.S. Cl.
CPC ..... *A63B 61/02* (2013.01); *A63B 61/003* (2013.01)

(58) Field of Classification Search
USPC ..... 472/492–494
See application file for complete search history.

(56) References Cited

U.S. PATENT DOCUMENTS 906,848 A * 12/1908 Atwell ..... A63B 61/02 473/493
1,526,126 A * 2/1925 Fitzherbert ..... A63B 61/02 473/493
4,595,155 A * 6/1986 Gough ..... A63B 61/02 242/395.1
9,598,896 B1 * 3/2017 Pichik ..... E06B 9/13
11,192,009 B1 * 12/2021 Saphire ..... A63B 61/003
11,900,834 B2 * 2/2024 Reiner ..... G09F 15/0062
12,338,681 B1 * 6/2025 Bickel ..... E06B 9/13
2005/0098770 A1 * 5/2005 Schell ..... E01F 13/028 256/25
2022/0193512 A1 * 6/2022 Callender, Jr. ..... A63B 61/02

FOREIGN PATENT DOCUMENTS

CN 213724733 U * 7/2021

OTHER PUBLICATIONS

CN213724733U English Translation (Year: 2020).*

* cited by examiner

*Primary Examiner* — Reginald S Tillman, Jr.
(74) *Attorney, Agent, or Firm* — LANWAY IPR SERVICES; Chun-Ming Shih

(57) ABSTRACT

In a flat roll-up structure for rolling up net body flatly, at upper and lower end of net body, it is installed respectively with protruding object, meanwhile, at roll-up mechanism, it is installed with upper and lower positioning roller module to limit the movement scope of net body, therefore, when net body is to be expanded, net body, through the guidance of upper and lower positioning roller structure, can be withdrawn flatly; when protruding object used to roll up net body is limited for its movement scope by upper and lower positioning roller module, and is limited by the limiting part of upper and lower positioning roller module, the net body can then be rolled up flatly without generating up and down shift, which can avoid the generation of tying problem due to unbalanced receiving in net body.

10 Claims, 8 Drawing Sheets

FLAT ROLL-UP STRUCTURE FOR ROLLING UP NET BODY

TECHNICAL FIELD

This invention relates to a flat structure for rolling up net body, it specifically relates to a net body having easy expansion or roll-up device installed on roll-up structure, on upper cap and lower cap of roll-up structure, it is installed with roll-up device used to fix net body location, and through the pulling or withdrawing of net body, net body can be taken out or expanded quickly, when net body is to be received, through the reel of roll-up structure and with the assistance of positioning structure, net body can be rolled up and received flatly in reel.

BACKGROUND

Ball sports is always sports favored by nationals of Taiwan, especially in recent years, some domestic athletes have acquired one after another the world's front-end rankings in tennis and badminton, therefore, in holidays, you can see people are practicing tennis, badminton or even volleyball in stadium or even in parks.

For the above mentioned sports, in addition to the need of ball and racket, a net is also needed to separate the court into two sides; in the present form, users have to prepare ball net, and after net body is expanded, it should be installed respectively or fixed on ball racks at both ends through ropes; however, drawbacks of the above mentioned structure are: 1. Lots of net grids are formed ball net and net body, and because ball net and net body themselves are of soft structures, therefore, they could easily get entangled and tied to each other, and time is needed to arrange them; 2. During every use, ball net and net body need to be expanded, therefore, it is quite time consuming to use it.

Therefore, some companies have developed a structure as shown in the announced China patent CN217187773U, wherein its first support pillar has hollow inside and opening in the side part; a rotational pole, which is installed in rotatable way inside the first support pillar, and a ball net having one end fixed first on the rotating pole so that when the rotational pole is rotating, ball net will be reeled in the opening of the first pillar; a base, which is fixed on the bottom of the first pillar; moreover, rotational pole is driven by driving and rotating component installed on the base and located at the bottom of the rotational pole to rotate. When it is needed to rotate rotational pole to receive or release the ball net, driving and rotating component can drive rotational pole to rotate within first support pillar and to realize the reeling or unreeling of ball net on the opening of first support pillar; however, the drawbacks of the above mentioned structures are as follows: 1. Because the ball net is fixed on a first support pillar, the upper and lower end of the ball net will have weaker supporting force, therefore, ball net will stand obliquely or get curly; 2. When ball net is to be reeled up, ball net will droop due to gravitational force, therefore, without other people's help, ball net will get tied when it is reeled up, or sometimes it will become difficult to be reeled up.

SUMMARY OF THE INVENTION

The main purpose of this invention is to provide a flat structure for roll-up of net body, which aims at improving the prior art ball net or roll-up structure for net body; on the upper and lower end of net body, it is installed respectively with one hard and protruding object to roll up net body on one reel; moreover, the above mentioned reel is assembled between one upper cap and one lower cap, moreover, a positioning roller set is set up in the upper and lower cap to limit the movement of the protruding object, therefore, through positioning roller set, the movement scope of net body is limited, consequently, ball net or net body can be expanded or received flatly in reel.

Therefore, the structure of this invention is made up of a net body and a roll-up mechanism;

The net body has a grid-shaped net surface, and upper end and lower end of the net surface is set up respectively with an edge trim made up of canvas, and on the edge trim, it is set up with a hard protruding object;

One side of the net body is associated at the roll-up mechanism and is driven by the roll-up mechanism to expand or receive net body;

The net body, at one side relatively associated with the roll-up mechanism, is set up with a straight traction part, and above the traction part, it is set up with a columnar body, through the holding of the columnar body of the traction part, the net body can be withdrawn or reeled up flatly;

The roll-up mechanism contains a reel, an upper cap, a lower cap and a connecting lever;

The above mentioned reel contains an inner shaft, and the inner shaft is coupled to the upper cap and the lower cap so that the inner shaft can rotate between the upper cap and the lower cap;

Outer side of the inner shaft is set up with outer barrel for roll-up and fixing by the net body, and the outer barrel is coupled to the above mentioned inner shaft so that the outer barrel can rotate together with the inner shaft;

The upper cap is set up at the upper end of the reel, and at the inner side of the upper cap, it is set up with an upper shaft connecting part, an upper roller positioning part and an upper connecting barrel;

The upper connecting shaft can provide coupling for inner shaft of the reel;

The upper roller positioning part is set up with a upper positioning roller set;

The above mentioned upper positioning roller set contains two sets of upper positioning roller, moreover, edge trim at upper side of the net body penetrates into the upper positioning roller set; and between those two upper positioning rollers, an upper position-limiting part for limiting protruding object on upper end of the net body is formed, and width of the upper position-limiting part is slightly larger than the protruding object so that the protruding object can move within the upper position-limiting part without separating from it, and an upper opening is set up at the upper cap at the front end of the upper roller positioning part, in addition, columnar body of the traction part, when the net body is reeling up, can stop and block at the front end of the upper positioning roller set;

The upper connecting barrel can provide coupling for the connecting lever;

The lower cap is installed at lower end of the reel, and at inner side of the lower cap, it is installed with a lower shaft connecting part, a lower roller positioning part and a lower connecting barrel;

The lower connecting shaft provides coupling for lower end of inner shaft of the reel;

The lower roller positioning part is installed with a lower positioning roller set;

The above mentioned lower positioning roller set contains two sets of lower positioning rollers, and edge trim at lower end of the net body penetrates into the lower positioning roller set; and between those two lower positioning rollers, a lower position-limiting part for limiting protruding object at lower end of the net body is formed, and width of the lower position-limiting part is slightly larger than the protruding object so that the protruding object can move inside the lower position-limiting part without separating from it, and the lower cap is installed with an opening at front end of the lower roller positioning part;

The lower connecting barrel provides coupling for the connecting lever;

Protruding object at upper and lower end of the net body penetrates respectively into upper position-limiting part of the above mentioned upper positioning roller set and lower position-limiting part of the above mentioned lower positioning roller set so that the net body, under limitation by the upper position-limiting part and the lower position-limiting part, can expand flatly or can be reeled up flatly in the reel.

In embodiment of this invention, wherein the protruding object is nylon rope.

In embodiment of this invention, wherein the upper cap and the lower cap is installed respectively with a connecting ring part, and each of the connecting ring part can be penetrated by a rope body. Therefore, when the structure of this invention is to be fixed, the above mentioned rope body is put on each of the connecting ring part, next, rope body is fixed on the ground or fixing rack of the ball game, therefore, this invention can be used stably.

In embodiment of this invention, wherein the lower cap is installed with a penetrating hole at the lower connecting barrel, and the connecting lever is a retractable stick, which can take out the connecting lever from the penetrating hole and fix this invention.

In embodiment of this invention, wherein the lower cap is installed with a penetrating hole at the lower connecting barrel, and the above mentioned penetrating hole can be penetrated by a fixing rack lever;

In embodiment of this invention, wherein the edge trim is folded to form a folding edge, and the folding edge is connected to the edge trim, and then the protruding object is cladded, therefore, protruding object is fixed and is prevented from dropping.

In embodiment of this invention, wherein the edge trim can adopt plastic injection molding to clad the edge of net surface.

In embodiment of this invention, wherein the edge trim has adopted thermos-compression technique so as to clad edge of the net surface, and the above mentioned edge trim, net surface and protruding object can be formed together through thermos-compression method.

In embodiment of this invention, wherein the inner shaft is further installed with a torsion spring, and one side of the torsion spring is embedded into one inner slot of the inner shaft, and the torsion spring is set up with predetermined length, meanwhile, at another side of the torsion spring, it is installed with one joint end, and the joint end is fixed on one outer slot of the outer barrel. Therefore, using elasticity of the torsion spring, when net body is expanded, the torsion spring will release a length so that net body can expand; moreover, when reeling up net body, the torsion spring will release elastically so that net body will make automatic roll-up.

In embodiment of this invention, wherein at outer side of the upper cap, it is further installed with rotational hand wheel, and the above mentioned rotational hand wheel is connected to upper shaft connecting piece of the reel. Through the driving of the rotational hand wheel, the net body can be expanded, or the user can rotate the rotational hand wheel with hand so that the net body can be reeled up on the reel.

Through the above mentioned descriptions, the features of this invention and its available functions are briefly described as follows:

1. When using it, hold the traction part to take out net body, because protruding object at upper and lower end of net body is limited for its movement location by upper positioning roller set and lower positioning roller set as set up at upper cap and lower cap, therefore, net body can be taken out as straight line.
2. When net body is to be reeled up, through the limitation of movement location of the above mentioned protruding object by upper positioning roller set and lower positioning roller set, net body can then be reeled up into reel as a straight line, and accompanied with columnar body at front end of net body, the separation of net body from upper positioning roller set and lower positioning roller set can be avoided.

DETAILED DESCRIPTION

In order to let your esteemed reviewer be able to have further understanding and recognition on the features of the present invention, the following better embodiments are presented accompanied with drawings for descriptions:

As shown from FIG. 1 to FIG. 4, the structure of this invention is made up of a net body 10, a roll-up mechanism 100.

Figure 1:
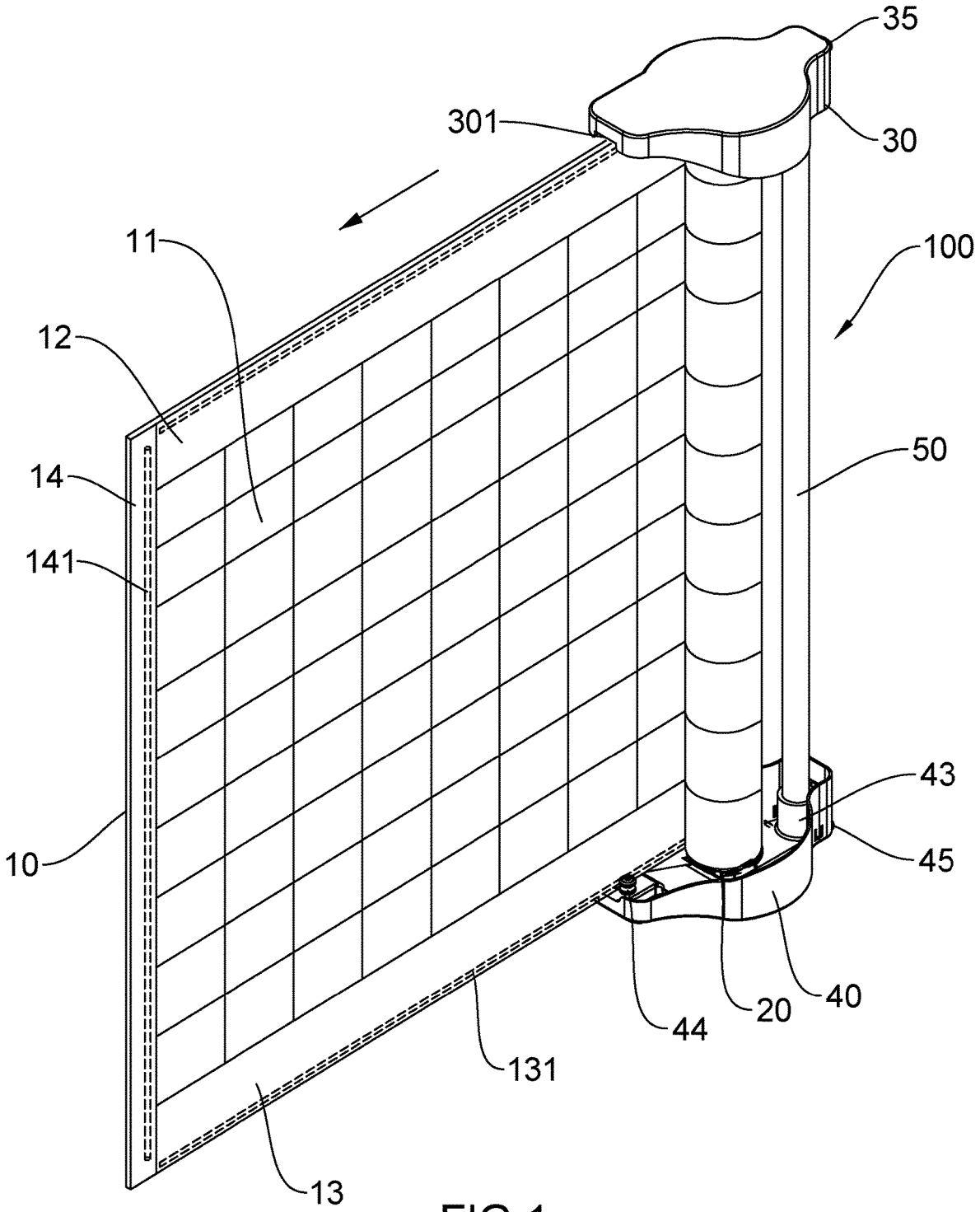
FIG. 1: The structural stereogram of this invention.
Figure 2:
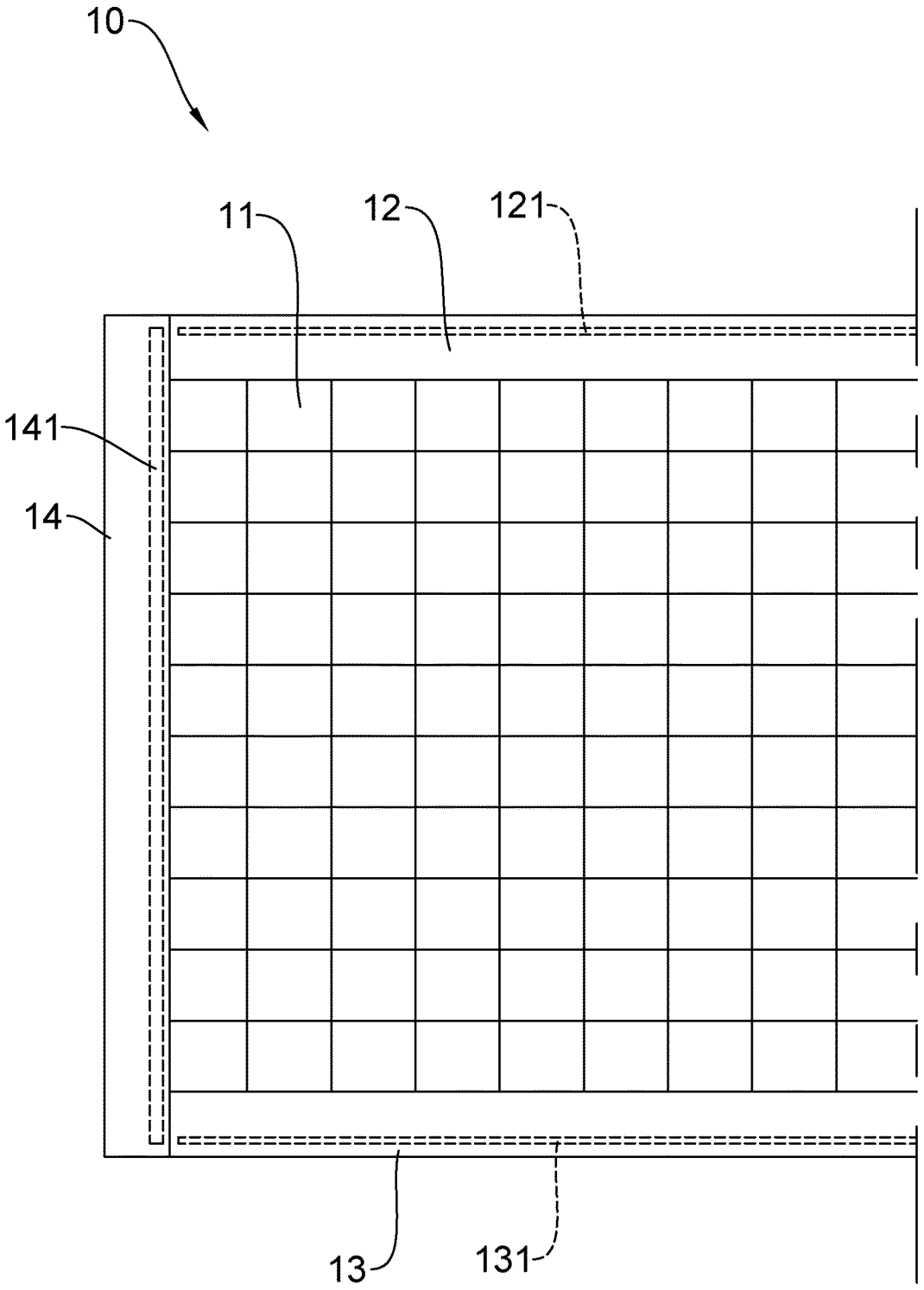
FIG. 2: It is structural diagram of net body.

As shown in FIGS. 1 and 2, the net body 10 has a grid-shaped net surface 11, and upper end and lower end of the net surface 11 is installed respectively with edge trim 12 and 13 made up of canvas; and on the respective edge trim 12 and 13, it is installed with a hard protruding object 121 and 131, and the above mentioned protruding object can be of material of nylon rope and hard and flexible strip object.

As shown in FIG. 1, one side of the net body 10 is associated above the roll-up mechanism 100, and is driven by the roll-up mechanism 100 to expand or to roll up and receive the net body 10.

As shown in FIG. 1 and FIG. 2, the net body 10, at one side relatively associated with the roll-up mechanism 100, is installed with a straight traction part 14, and above the traction part 14, it is installed with a columnar body 141, through holding columnar body 141 of the traction part 14, the net body 10 can be withdrawn or reeled up flatly.

What worth noticing is that edge trim 12 and 13 is folded into a folded edge (not drawn in the figure), and the folded edge is joined with the edge trim 12 and 13 to clad the protruding object 121 and 131, therefore, protruding object 121 and 131 are fixed and prevented from dropping. In addition to using folded edge method to use edge trim 12 and 13 to fix protruding object 121 and 131, in some embodiments, each of the edge trim 12 and 13 can further be of plastic injection molding so as to clad the edge of net surface 11, next, protruding object 121 and 131 are assembled into edge trim 12 and 13. In addition to that, each of the edge trim 12 and 13 has adopted thermos-compression technique so as to clad edge of the net surface 11; moreover, the above mentioned net surface 11, edge trim 12 and 13 and protruding object 121 and 131 can be formed together using thermos-compression method.

As shown in FIGS. 1 and 2, one side of the net body 10 is associated above the roll-up mechanism 100, and is driven by the roll-up mechanism 100 to expand or to roll up and receive the net body 10.

Figure 3:
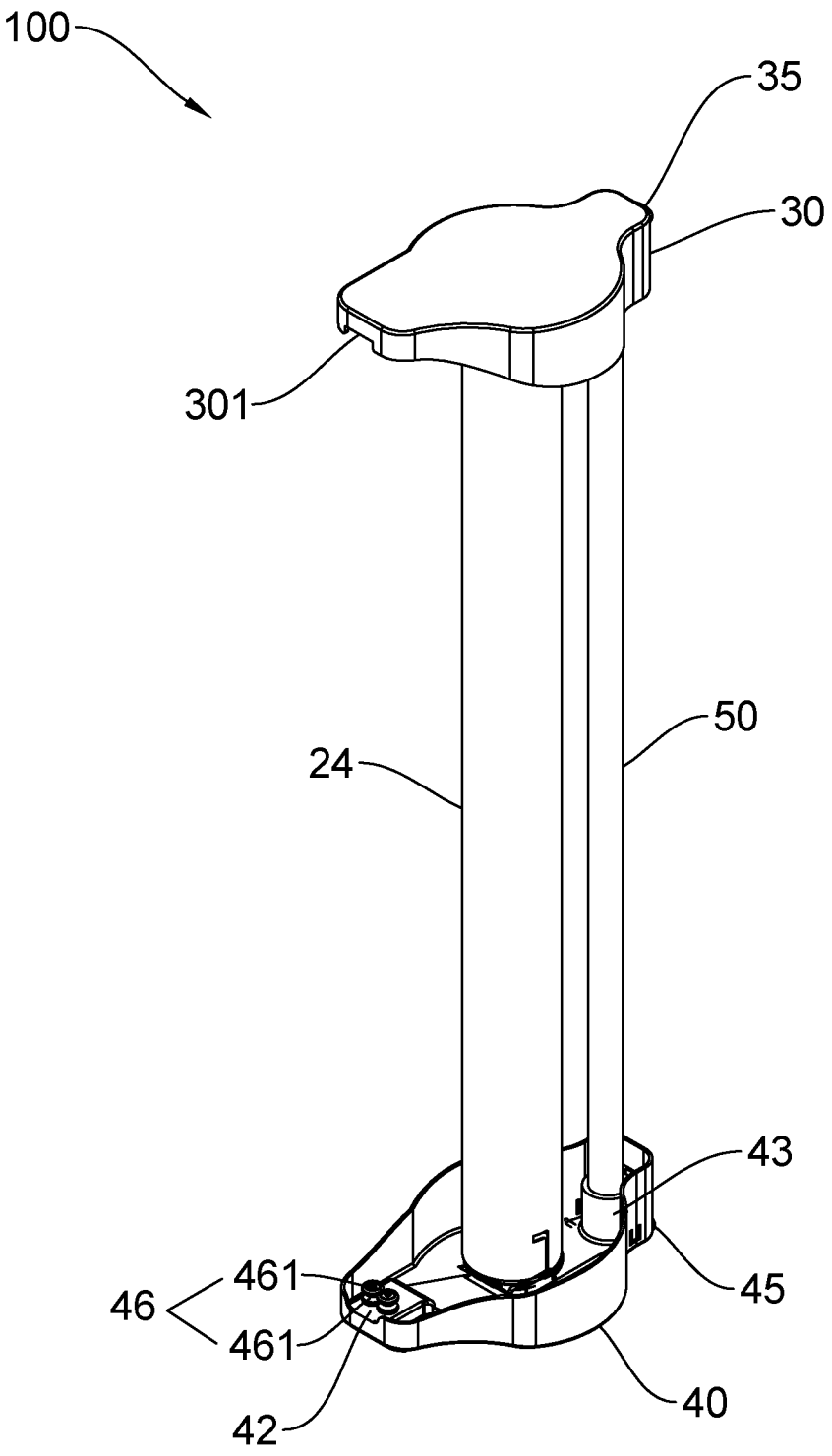
FIG. 3: It is structural diagram of roll-up mechanism.
Figure 4:
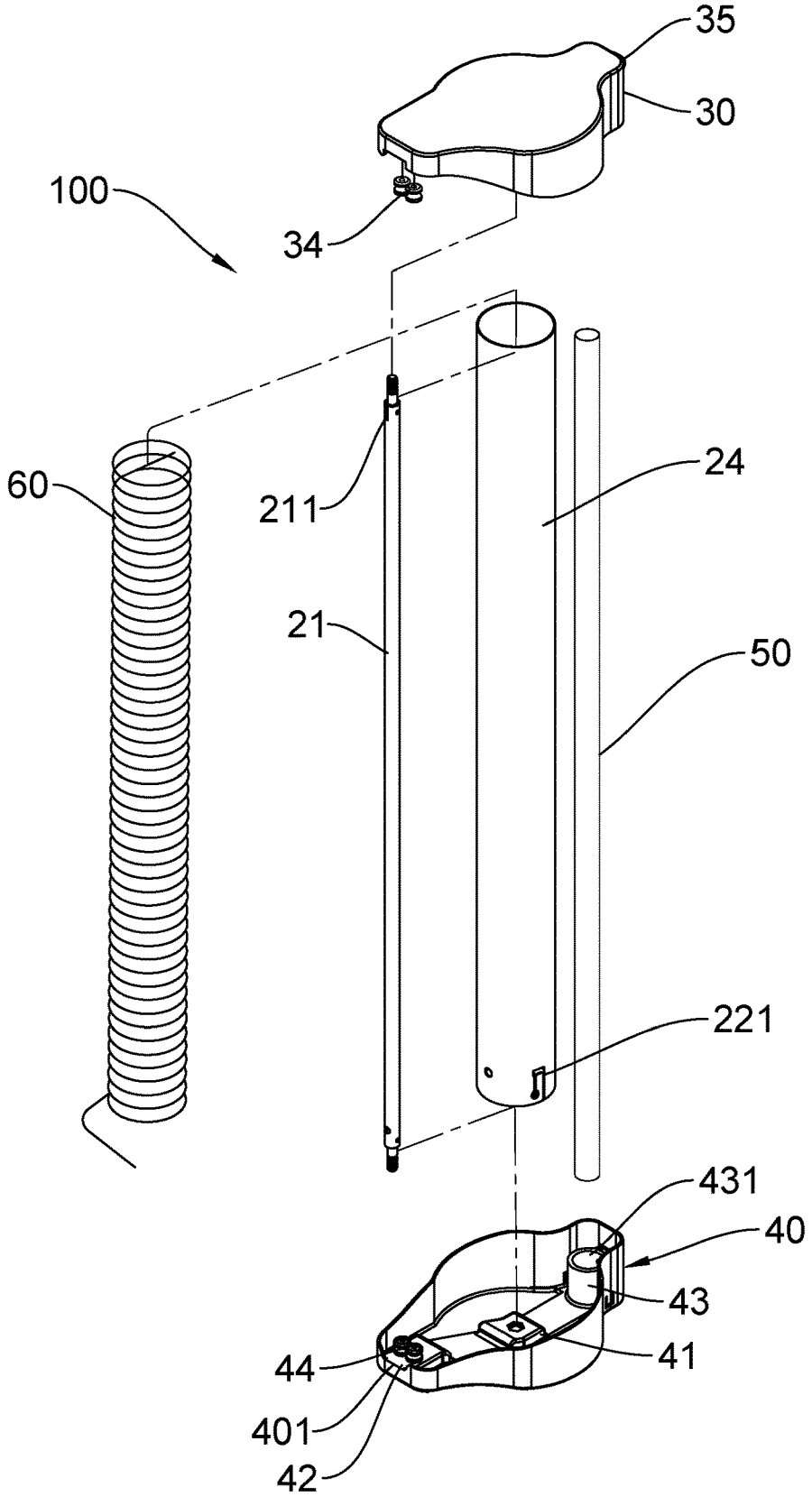
FIG. 4: It is structural decomposition diagram of roll-up mechanism.
Figure 5:
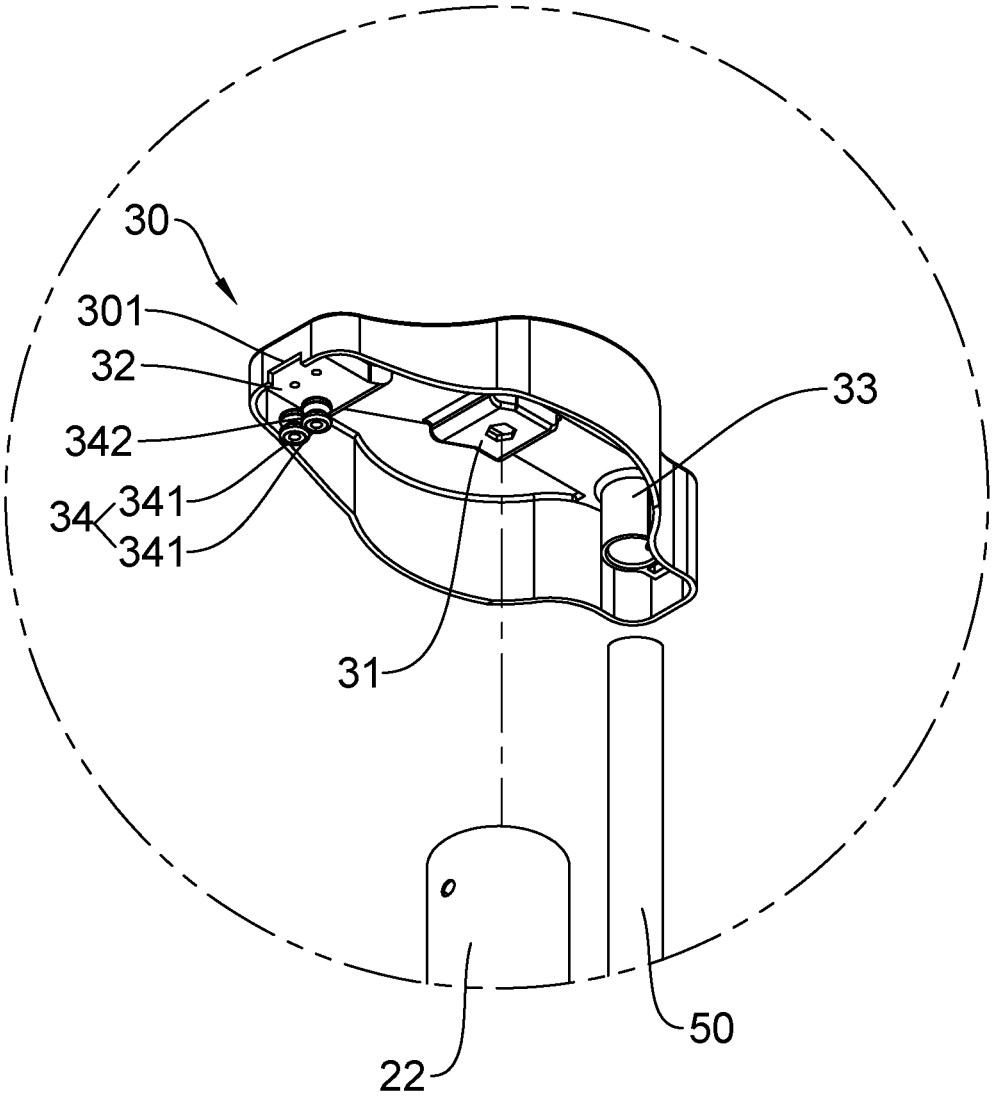
FIG. 5: It is structural diagram of upper cap.
Figure 6:
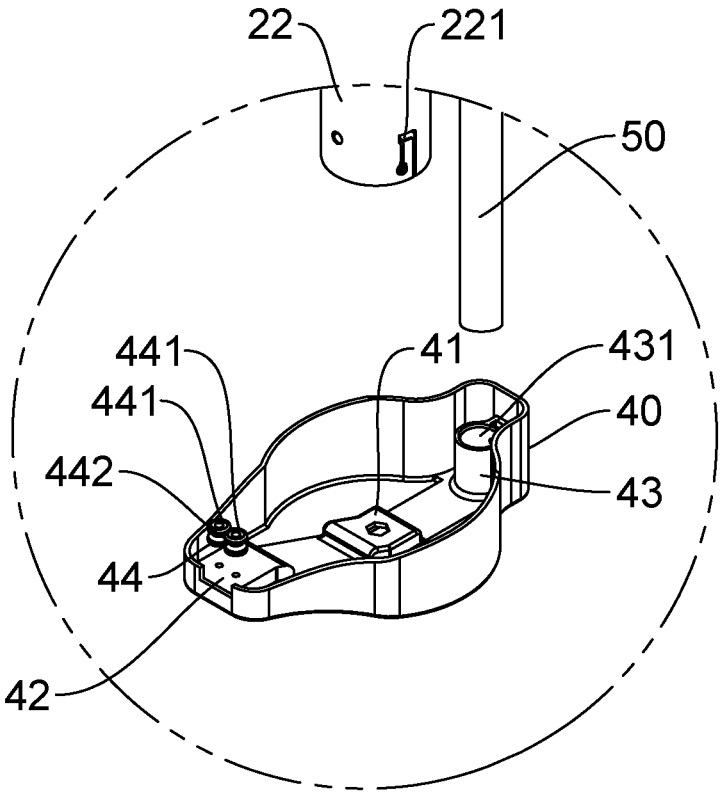
FIG. 6: It is structural diagram of lower cap.

As shown in FIGS. 1, 3 and 4, the roll-up mechanism 100 is made up of a reel 20, an upper cap 30, a lower cap 40 and a connecting lever 50.

As shown in FIGS. 3 and 4, the above mentioned reel 20 contains an inner shaft 21 and an outer barrel 22, and the inner shaft 21 coupled to the upper cap 30 and lower cap 40 so that the inner shaft 21 can rotate between the upper cap 30 and the lower cap 40.

As shown in FIGS. 3 and 4, the outer barrel 22 is set up at the outer side of the inner shaft 21, and the outer barrel and the above mentioned inner shaft is coupled to 21 so that the outer barrel 22 can rotate together with the inner shaft 21.

As shown in FIGS. 3 and 4, in the main embodiment of this invention, the reel 20 has adopted spring winding mechanism to achieve the function of automatic roll-up; please continue to refer to FIG. 3 and FIG. 4, wherein the inner shaft 21 is provides a site for installation of torsion spring 60, and for the body of inner shaft 21, it has an inner slot 211, and one side of the above mentioned torsion spring 60 is embedded into the inner slot 211 for fixing, and another side of the torsion spring 60 is embedded into outer slot 221 of the outer barrel 22; when pulling net body 10 installed at the reel 20, outer barrel 22 can rotate to achieve the purpose of expansion of net body 10; when releasing net body 10, the torsion spring will release elastically to bring further the outer barrel 22 to rewind, consequently, net body 10 can be reeled up and received into the reel 20.

The above mentioned embodiment method is to use torsion spring 60 to make automatic roll-up, in addition, outer side of the upper cap 30 can be further installed with a rotational hand wheel (not drawn in figure), and the above mentioned rotational hand wheel is connected to upper shaft connecting piece 22 of the reel 20. Under the driving of the rotational hand wheel, the net body 10 can then expand, or the user can rotate the rotational hand wheel manually to roll up and receive the net body 10 into reel 20.

As shown in FIGS. 1, 3, 4 and 5, the upper cap 30 is installed at the upper end of the reel 20, and at inner side of the upper cap 30, it is installed with a upper shaft connecting part 31, an upper roller positioning part 32 and an upper connecting barrel 33.

As shown in FIGS. 1, 3, 4 and 5, the upper connecting shaft 31 provides a site for coupling of inner shaft 21 of the reel 20.

As shown in FIGS. 1, 3, 4 and 5, the upper roller positioning part 32 is installed with an upper positioning roller set 34.

As shown in FIGS. 1, 3, 4 and 5, the above mentioned upper positioning roller sets 34 contain two sets of upper positioning rollers 341, and edge trim 12 at upper end of the net body 10 penetrates into the upper positioning roller set 34; and between those two upper positioning rollers 341, upper position-limiting part 342 used to limit protruding object 121 at upper end of the net body 10 is formed, and width of the upper position-limiting part 342 is roughly larger the protruding object 121, therefore, the protruding object 121 can move within the upper position-limiting part 342 without separating from it, furthermore, the upper cap 30 is installed with an upper opening 301 at the front end of the upper roller positioning part 32, in addition, columnar body 141 of the traction part 14, when the net body 10 is rolling up, can just stop and block at the front end of the upper positioning roller set 34.

As shown in FIGS. 1, 3, 4 and 5, the upper connecting barrel 33 provides a site for installation of the connecting lever 50.

As shown in FIGS. 1, 3, 4 and 6, the lower cap 40 is installed at the lower end of the reel 20, and at inner side of the lower cap 40, it is installed with a lower shaft connecting part 41, a lower roller positioning part 42 and a lower connecting barrel 43.

As shown in FIGS. 1, 3, 4 and 6, the lower connecting shaft 41 provides a site for connection of lower end of inner shaft 21 of the reel 20.

As shown in FIGS. 1, 3, 4 and 6, the lower roller positioning part 42 is installed with a lower positioning roller set 44.

As shown in FIGS. 1, 3, 4 and 6, the above mentioned lower positioning roller set 44 contain two sets of lower positioning rollers 441, and edge trim 13 at lower end of the net body 10 penetrates into the lower positioning roller set 44; and between those two lower positioning rollers 441, lower position-limiting part 442 used to limit protruding object 131 at lower end of the net body 10 is formed, and width of the lower position-limiting part 442 is slightly larger than the protruding object 131 so that the protruding object 131 can move within the lower position-limiting part 442 without separating from it; and the lower cap 40 is installed with a lower opening 401 at front end of the lower roller positioning part 42.

As shown in FIGS. 1, 3, 4 and 6, the lower connecting barrel 43 provides a site for installation of the connecting lever 50.

As shown in FIGS. 1, 3, 4 and 6, protruding object 121 and 131 at the upper and lower end of the net body 10 penetrates respectively into upper position-limiting part 342 of the above mentioned upper positioning roller set 34 and lower position-limiting part 442 of the above mentioned lower positioning roller set 44 so that the net body 10, under limitation by the upper position-limiting part 342 and the lower position-limiting part 442, can expand flatly, or be rolled up and received flatly into the reel 20.

Figure 7:
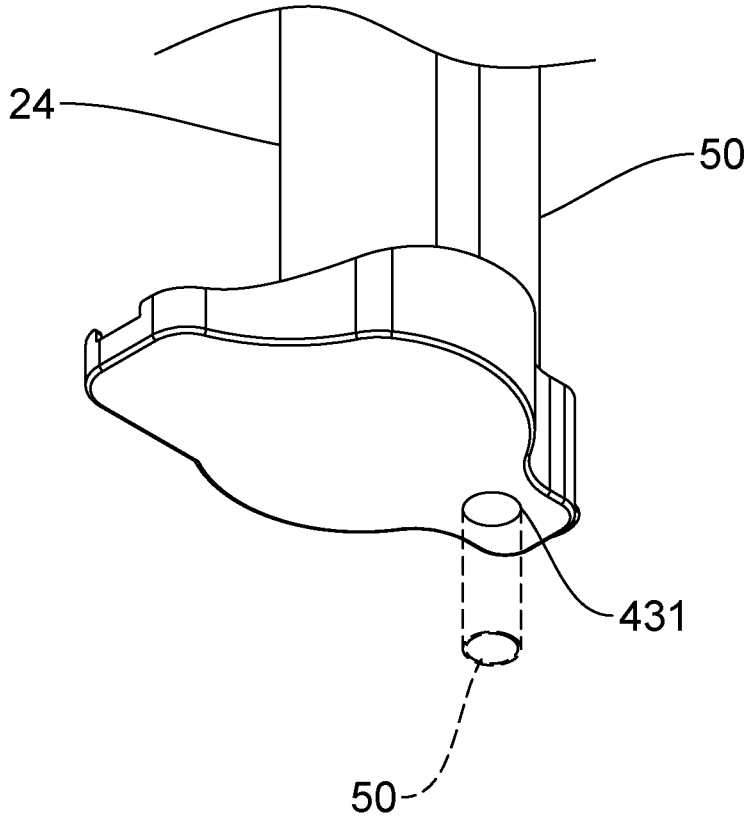
FIG. 7: It is usage schematic drawing (1) of this invention.

As shown in FIGS. 3 and 7, the lower cap 40 is installed with a penetrating hole 431 at the lower connecting barrel 43, and the connecting lever 50 is a retractable stick used to take out the connecting lever 50 from the penetrating hole 431 so as to fix the present invention.

Figure 8:
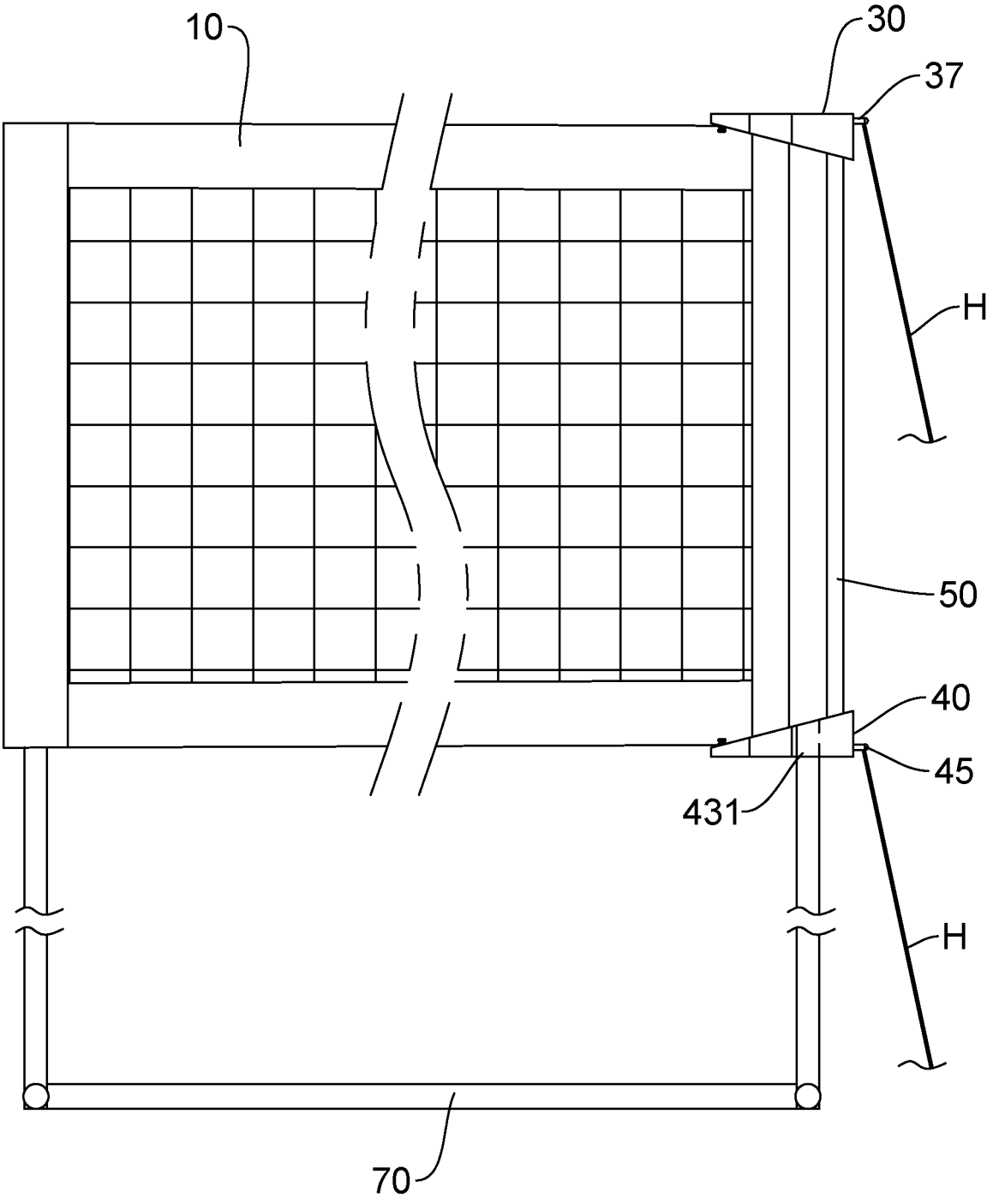
FIG. 8: It is usage schematic drawing (2) of this invention.

As shown in FIG. 8, the upper cap 30 and the lower cap 40 is installed respectively with connecting ring part 35 and 45, and each of the connecting ring part 35 and 45 provides site for penetration and hitching by a rope body H. Therefore, when the structure of this invention is to be fixed, the above mentioned rope body H penetrates and hitches on each of the connecting ring part 35 and 45, next, rope body H is fixed on the ground or the fixing rack of the ball game, consequently, this invention can be used firmly.

As shown in FIG. 8, according to the technique of the above mentioned embodiment, for further embodiment, the lower cap 40 can be selected, and a penetrating hole 431 is installed at the lower connecting barrel 43, and the above mentioned penetrating hole 431 can be penetrated by a fixing pole 70.

To summarize, it is clear that the structure of this invention was not ever published in books or used in public, therefore, it can conform to the application keys of patent invention, hopefully, your esteemed office could give this patent a favorable approval.

DESCRIPTION OF SYMBOLS

10: Net body
11: Net surface
12, 13: Edge trim
121, 131: Protruding object
14: Traction part
141: Columnar body
100: Roll-up mechanism
20: Reel
21: Inner shaft
211: Inner slot
22: Outer barrel
221: Outer slot
30: Upper cap
301: Upper opening
31: Upper shaft connecting part
32: Upper roller positioning part
33: Upper connecting barrel
34: Upper positioning roller set
341: Upper positioning roller
342: Upper position-limiting part
35: Connecting ring part
40: Lower cap
401: Lower opening
41: Lower shaft connecting part
42: Lower roller positioning part
43: Lower connecting barrel
431: Penetrating hole
44: Lower positioning roller set
441: Lower positioning roller
442: Lower position-limiting part
45: Connecting ring part
50: Connecting lever
60: Torsion spring
70: Fixing pole
H: Rope body

What is claimed is:

1. A flat roll-up structure for rolling up net body flatly, comprising of a net body and a roll-up mechanism;

wherein, the net body contains a grid-shaped net surface, and on upper end and lower end of a net surface, an edge trim made up of canvas is installed respectively, meanwhile, at the edge trim, a hard protruding object is installed;

one side of the net body is associated at the roll-up mechanism, and is driven by the roll-up mechanism to expand or roll up and receive the net body;

the net body, at one side relatively associated with the roll-up mechanism, is installed with one straight traction part, and above the traction part, a columnar body is installed, through the holding of columnar body of the traction part, the net body can be withdrawn or rolled up and received flatly;

the roll-up mechanism contains a reel, an upper cap, a lower cap and a connecting lever;

the reel contains an inner shaft, and the inner shaft is connected to the upper cap and lower cap so that the inner shaft can rotate between the upper cap and lower cap;

an outer side of the inner shaft is installed with an outer barrel for roll-up and fixing by the net body, and the outer barrel is connected to the inner shaft so that the outer barrel can rotate along with the inner shaft;

the upper cap is installed at upper end of the reel, and an inner side of the upper cap is installed with an upper shaft connecting part, an upper roller positioning part and an upper connecting barrel;

the upper connecting shaft part is connected by an inner shaft of the reel;

the upper roller positioning part is installed with an upper positioning roller set;

the upper positioning roller set contains two sets of upper positioning rollers, and the edge trim at upper end of the net body penetrates into the upper positioning roller set; and between the two upper positioning rollers, an upper position-limiting part used to limit a protruding object at upper end of the net body is formed, and an width of the upper position-limiting part is slightly larger than the protruding object so that the protruding object can move within the upper position-limiting part without separating therefrom, and the upper cap, at the front end of the upper roller positioning part, is installed with an upper opening, in addition, a columnar body of the traction part, when the net body is rolled up and received, can just stop and block the front end of the upper positioning roller set;

the upper connecting barrel provides a site to be installed by the connecting lever;

the lower cap is installed at the lower end of the reel, and at an inner side of the lower cap, a lower shaft connecting part, a lower roller positioning part and a lower connecting barrel are installed;

the lower connecting shaft is to be connected by a lower end of the inner shaft of the reel;

the lower roller positioning part is installed with a lower positioning roller set;

the lower positioning roller set contains two sets of lower positioning rollers, and the edge trim at lower end of the net body penetrates into the lower positioning roller set; and between the two lower positioning rollers, a lower position-limiting part used to limit the protruding object at lower end of the net body is formed, and an width of the lower position-limiting part is slightly larger than the protruding object so that the protruding object can move within the lower position-limiting part without separating therefrom; and for the lower cap, one lower opening at front end of the lower roller positioning part are installed;

the lower connecting barrel provides a site to be installed by the connecting lever;

the protruding object at upper and lower end of the net body penetrates respectively through an upper position-limiting part of the upper positioning roller set and lower position-limiting part of the lower positioning roller set so that the net body, limited by the upper position-limiting part and the lower position-limiting part, can expand flatly, or can be rolled up and received into the reel flatly.

2. The flat roll-up structure for rolling up net body flatly of claim 1, wherein, the protruding object is nylon rope.

3. The flat roll-up structure for rolling up net body flatly of claim 1, wherein, the upper cap and the lower cap is installed respectively with a connecting ring part, and each of the connecting ring part can be penetrated hitched by a rope body.

4. The flat roll-up structure for rolling up net body flatly of claim 1, wherein, the lower cap, at the lower connecting barrel, is installed with a penetrating hole, and the connecting lever is a retractable stick, which is capable of taking out the connecting lever from the penetrating hole.

5. The flat roll-up structure for rolling up net body flatly of claim 1, wherein, the lower cap, at the lower connecting barrel, is installed with a penetrating hole, and the penetrating hole can be penetrated by a fixing pole.

6. The flat roll-up structure for rolling up net body flatly of claim 1, wherein, the edge trim is folded to form a folded edge, and the folded edge is joined to the edge trim and to clad the protruding object, therefore, the protruding object can be fixed and prevented from dropping.

7. The flat roll-up structure for rolling up net body flatly of claim 1, wherein, the edge trim can adopt plastic injection molding to clad further the edge of net surface.

8. The flat roll-up structure for rolling up net body flatly of claim 1, wherein, the edge trim is adopted thermos-compression technique so as to clad edge of the net surface; the edge trim, the net surface and the protruding object can be formed together using a thermos-compression method.

9. The flat roll-up structure for rolling up net body flatly of claim 1, wherein, the inner shaft is installed with a torsion spring, and one side of the torsion spring is embedded into an inner slot of the inner shaft, and the torsion spring is installed with predetermined length, in another side of the torsion spring, a joint end is installed, and the joint end is fixed at an outer slot of the outer barrel.

10. The flat roll-up structure for rolling up net body flatly of claim 1, wherein, at outer side of the upper cap, a rotational hand wheel is further installed, and the rotational hand wheel is connected to upper shaft connecting piece of the reel.

* * * * *